US007185767B2

(12) United States Patent
Phillips

(10) Patent No.: US 7,185,767 B2
(45) Date of Patent: Mar. 6, 2007

(54) DESK ORGANIZER

(75) Inventor: David Phillips, Barrington Hills, IL (US)

(73) Assignee: Custom Plastics Inc., Elk Grove Village, IL (US)

( * ) Notice: Subject to any disclaimer, the term of this patent is extended or adjusted under 35 U.S.C. 154(b) by 395 days.

(21) Appl. No.: 10/819,559

(22) Filed: Apr. 6, 2004

(65) Prior Publication Data

US 2005/0000921 A1 Jan. 6, 2005

Related U.S. Application Data

(63) Continuation-in-part of application No. 10/446,169, filed on May 23, 2003, now Pat. No. 6,968,957.

(51) Int. Cl.
*B42F 17/00* (2006.01)

(52) U.S. Cl. ..... 211/11

(58) Field of Classification Search ..... 211/13.1, 211/10, 11, 162

See application file for complete search history.

(56) References Cited

U.S. PATENT DOCUMENTS 4,034,864 A * 7/1977 Tyson et al. ..... 211/50
4,074,810 A 2/1978 Juergens et al.
4,438,852 A 3/1984 Evans
4,542,832 A * 9/1985 Minick et al. ..... 211/106
4,740,044 A 4/1988 Taylor
4,828,120 A * 5/1989 Beil et al. ..... 211/88.01
D321,011 S 10/1991 Blossom
5,152,405 A 10/1992 Schriner
5,197,614 A 3/1993 Dalton et al.
5,601,193 A 2/1997 Santoya
5,775,521 A * 7/1998 Tisbo ..... 211/94.01

* cited by examiner

*Primary Examiner*—Sarah Purol
(74) *Attorney, Agent, or Firm*—McHale & Slavin P.A.

(57) ABSTRACT

A desk organizer having a horizontally disposed rail is mounted over a desk by use of a support base secured to the desk, or a support base secured to walls surrounding the desk, such as those found in office cubicles. The desk support base includes an elongated rod carrying a spindle which extends vertically from the support base. The spindle and rod have several receptacles at different levels above the support surface and are rotatably mounted on the support base. The rail can support numerous receptacles along the length thereof by use of slots located on either side surface of the rail. In addition, a slot located along the top surface of the rail permits the placement of self supporting items such as envelopes, cards, notes and the like.

18 Claims, 6 Drawing Sheets

DESK ORGANIZER

RELATED APPLICATION

This invention is a continuation-in-part of U.S. patent application Ser. No. 10/446,169, filed May 23, 2003, now U.S. Pat. No. 6,968,957, the contents of which are incorporated herein by reference.

FIELD OF THE INVENTION

The present invention relates to desk organizers and, in particular, improves upon the related patent application by providing a horizontal rail to allow desk organizing receptacles to be positioned along the length of a desk.

BACKGROUND OF THE INVENTION

Desktop organizer assemblies are very popular in today's business environment providing additional storage areas by which people can sort and store documents and other items. Most every desk has some type of organizer to separate and catagorize items needed to perform the functions of the user. Typically found are receptacles for letters, pencils, paper clips and the like, all of which consume valuable desk space. Additionally, some sort of device is typically present that manages work flow and messages. Unfortunately, many of the prior art devices are so large and complex that the usable desk space is reduced.

One type of organizer assembly that has become popular is a multi-tray organizer assembly in which a plurality of trays are stacked one on top of the other in a compact vertical arrangement. Vertically stacked multi-tray organizers provide the user with a plurality of trays for storing different categories of documents, with each of the trays being easily assessible due to the vertical stacked nature of the trays.

U.S. Pat. No. 5,601,193 discloses a static stand with message clips, note pads, calendar, and a small turn-table for notes. Because the various elements are spaced about the stand, it requires a large area of desk space. The stand is disclosed as a device helpful in prioritizing needed actions.

U.S. Des. Pat. No. 321,011, issued to Blossom, shows another static organizer with several receptacles for different sized articles and a rack for larger parcels or files.

U.S. Pat. No. 4,438,852 discloses a modular desk organizer having a plurality of vertical and horizontally spaced bins for sorting of envelopes and the like items.

U.S. Pat. No. 4,074,810 discloses a combination tiered letter tray having vertical and horizontal bins for use in sorting.

U.S. Pat. No. 4,740,044 discloses a vertical desk organizer unit that fits across the back of a desk. This disclosure recognizes the need to maintain valuable desktop working area but accomplishes the task by extending the width of the desk, which may not be appropriate in many situations.

Other related desk organizers are disclosed by U.S. Pat. No. 5,197,614 and U.S. Pat. No. 5,152,405. These devices are also useful in collecting items and reducing desk-top clutter.

What is needed in the art is an organizer that can be used to receive various items, prioritize responses, reduce the amount of working space occupied by the organizer but keep everything within conveniently easy reach.

SUMMARY OF THE PRESENT INVENTION

Disclosed is a desk organizer for mounting on a support structure, such as a desk or between the walls of an office cubical, for use in organizing miscellaneous items without the use of valuable desk space. In a first embodiment, the desk organizer employs a pair of post support bases that releasably secured to the opposite edges of a desk, or table top. Each post support includes an elongated rod having a longitudinal axis with a first end and a second end. The first end of the elongated rod is attached to the post support base and a tubular spindle is rotatably mounted about the longitudinal axis of the rod. The spindle having a bottom end and a top end, the bottom end of the spindle in rotating contact with rod with a rail receptacle mounted on the spindle intermediate to the bottom end. The top end extending normal to the longitudinal axis whereby the rail receptacle and spindle can rotate about the rod. A rail is positioned between the spindles by insertion of each end of the rail into the rail receptacle. The rail includes side slots that allow for numerous sized and shaped receptacles to be attached thereto. A slot on the top surface of the rail may be used for holding miscellaneous items such as cards and notes. In addition, each spindle may include various stacked receptacles as disclosed in the prior application. In an alternative mounting embodiment, the rail is attached to the walls of a cubicle by use of wall supports that are attached to the wall. In this embodiment, the desktop support structure is completely eliminated so that no desktop footprint is required.

Thus, it is an objective of the present invention to provide a desk organizer with multiple receptacles placed over the working surface of a desk.

It is another objective of the present invention to provide multiple horizontal and vertically disposed receptacles with minimal space consumption.

It is a further objective of the present invention to provide eccentric rotation of various receptacles when post supports are employed to move the receptacles laterally closer to the user.

It is yet another objective of the present invention to provide modular construction of the desk organizer to permit personalization by the user.

It is yet a further objective of the present invention to provide receptacles and dishes on the desk organizer with different retaining devices.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Figure 1:
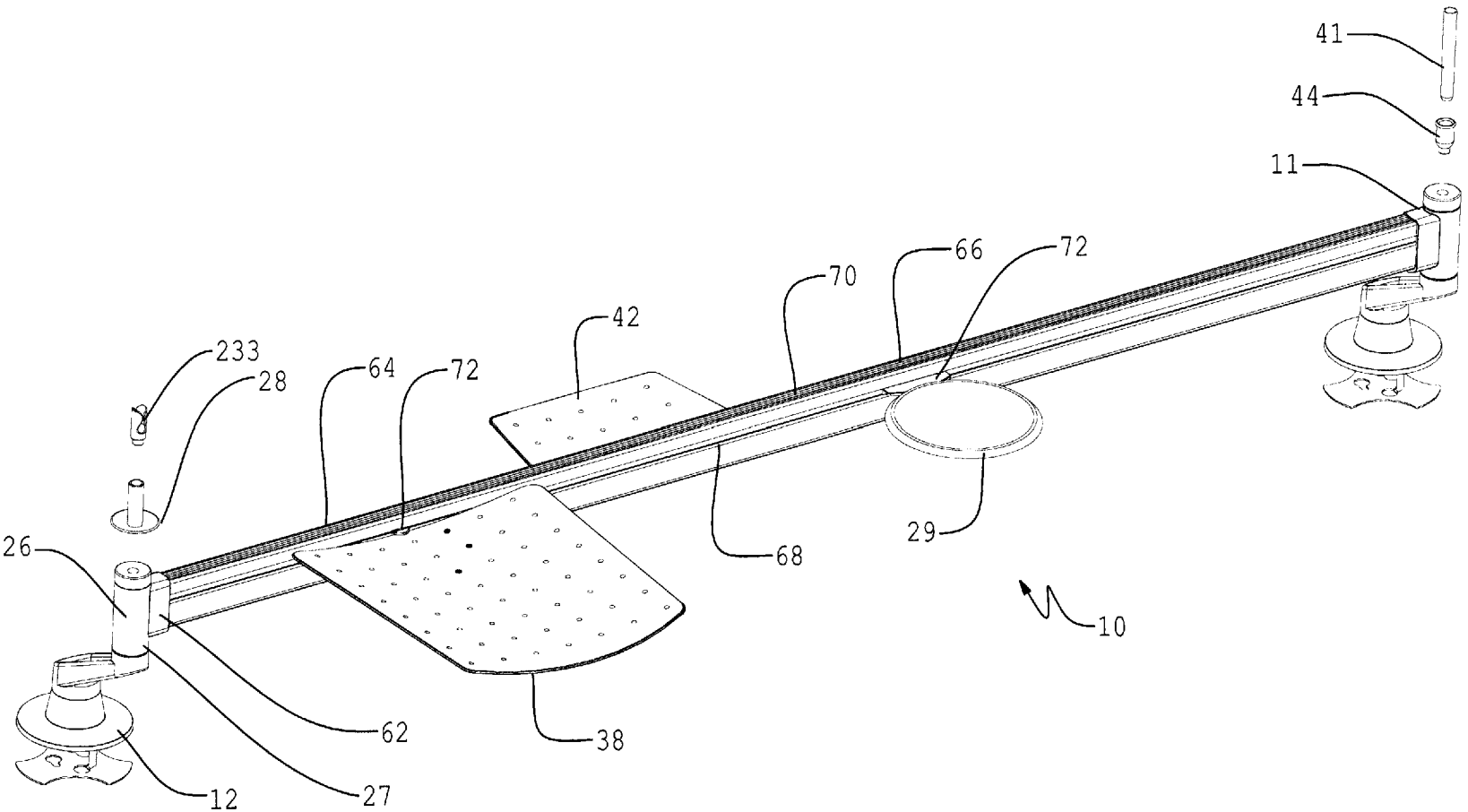
FIG. 1 is a perspective view of the desk organizer for attachment to a desk.
Figure 2:
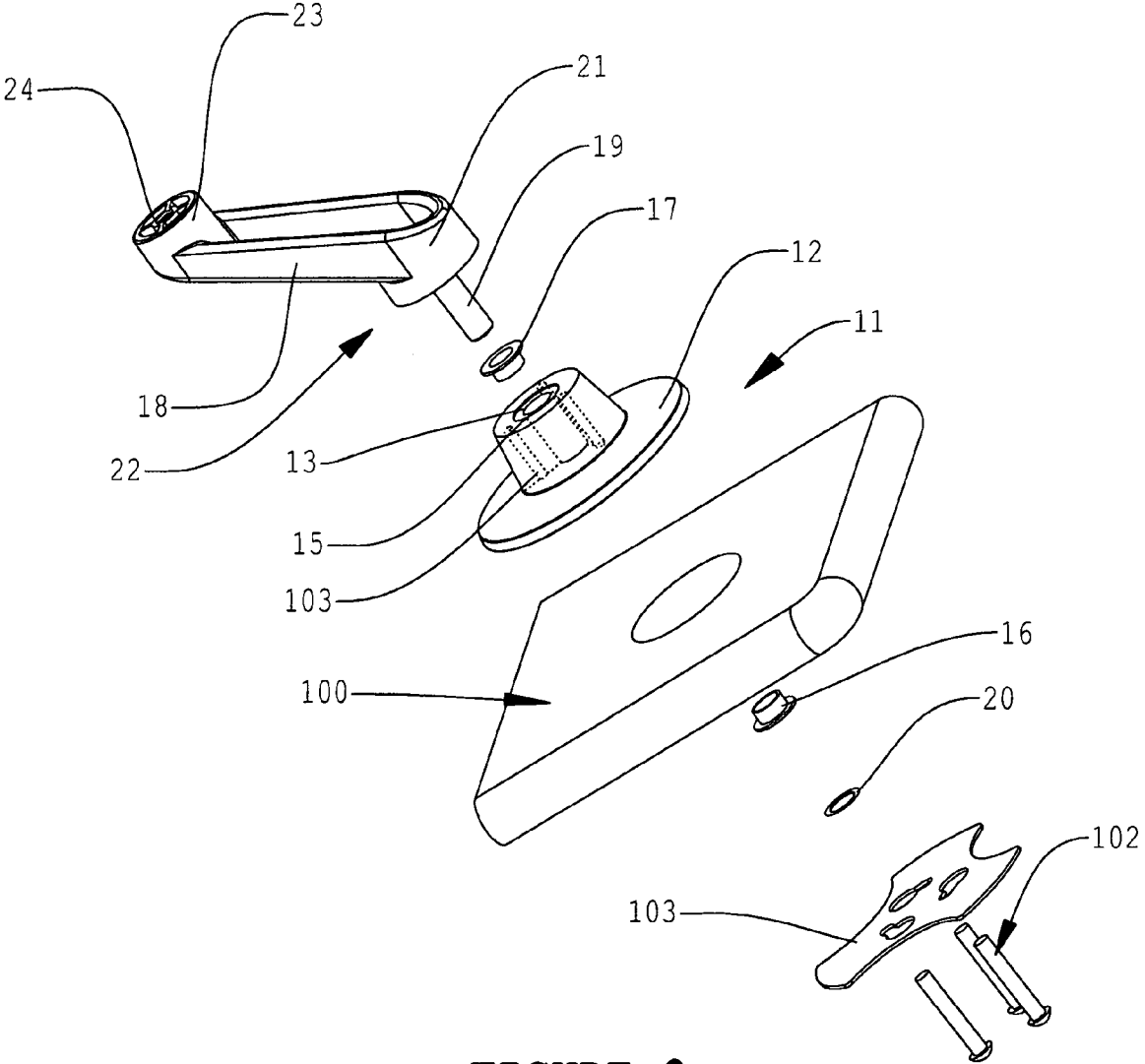
FIG. 2 is an exploded view of the support base and angle arm for the desk organizer.
Figure 3:
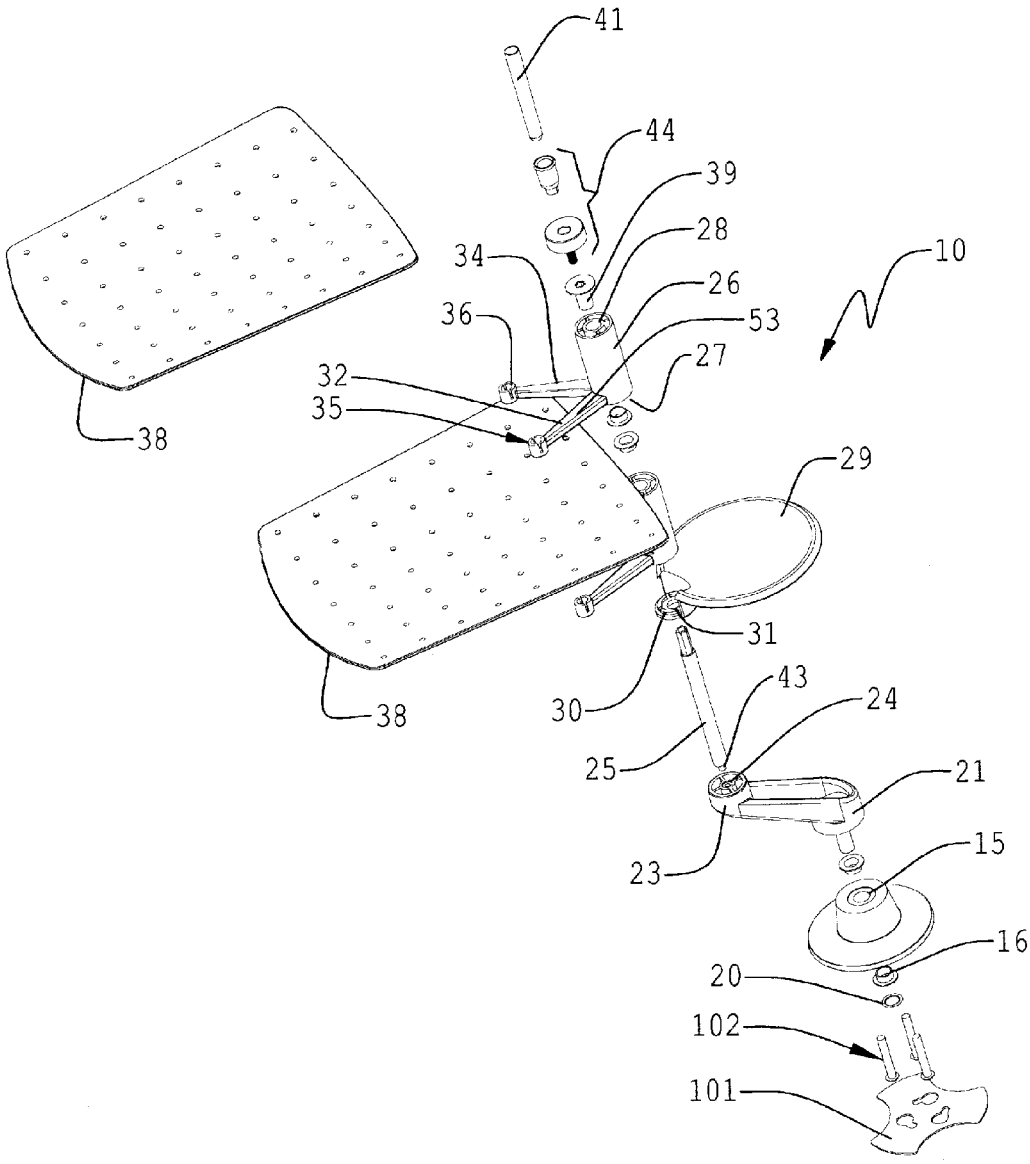
FIG. 3 is an exploded view of the support base with receptacles.

Referring now to FIGS. 1–3, shown is a desktop mounting embodiment of the desk organizer 10 for mounting to a support surface 100 such as a desk or table or other suitable support by use of support base 11. The support base 11 provides stability and rigidity to the desk organizer by use of an enlarged circumference 12 which is placed in contact with the support surface. It should be noted that while the support base that is shown is circular, it may have other geometric forms. The support base illustrated is secured to the support surface by mounting plate 101 and screws or bolts 102. Alternatively, the support base may be affixed to the support surface by other devices, such as clamps, magnets or adhesives.

The support base has a central aperture 13 and within the aperture are the connectors 103 for the bolts 102. Also within the central aperture 13 is a bore 15. Bushings 16, 17 are fitted within the bore 15. An angle arm 18 is rotatably mounted on the support base 11 by an axle 19 extending from one end 21 of the angle arm. The axle 19 rotates in the bushings 16 and 17. The free end of the axle 19 extends through the bushings and is fastened with a locking washer 20 completing the assembly of this module. The angle arm 18 and axle 19 form a crank arm 22 that displaces the second end 23 horizontally and vertically from the first end 21. The second end 23 of the angle arm 18 has a threaded well 24 which is approximately parallel with the axle 19. An elongated rod 25 having a threaded end 43 is threaded into the well 24 and extends outwardly from the angle arm in the opposite direction from the axle 19.

Two post supports are secured to the support surface with the angle arm extending laterally from the center of the support base to rotate in a plane parallel to the support surface. As it rotates, the elongated rod is substantially perpendicular to the support surface and describes a cylinder about the support base that has the angle arm as a radius. An elongated tubular spindle 26 is mounted on the rod 25. The spindle has a bottom end 27 and a top end 28 with a socket 62 there between. As shown in FIG. 1, the top end of one of the spindles includes a gripper 41 sized to receive CD and DVD discs. The other top end of the spindle shown in FIG. 1 includes a slot 233 which permits placement of large envelopes. As best depicted in FIG. 3, intermediate the ends of the tubular spindle, there is a bracket 32. The bracket is shown as two laterally extending arms 34, 53 with bores 35, 36 in the ends of the arms. A receptacle 38 is attached to the bracket with fasteners extending through the bores 35, 36, and into the receptacle. The orientation of the arms of the bracket and the cross-sectional shape of the receptacle are such that the receptacle will be substantially parrallel with the support surface when attached to the spindle.

The embodiment shown in FIG. 3, also illustrates a dish 29 connected to the rod 25. The dish has a semi-circular flange 30 in the periphery defined by a semi-circular recess which receives the bottom end 27 of the spindle. The flange 30 has an aperture 31 through which the elongated rod 25 passes securing the dish to the rod. The dish 29 may have a concave surface as shown in FIG. 3. Moreover, the dish may be round, oval, or rectilinear in outline.

Rail 64 extends between the two support bases 11 and is secured thereto by insertion into the receiving socket 62 of each spindle. The rail 64 consists of a slot 66 extending along the length of the top edge, and side slots 68 and 70 located on each side of the rail. Side slots 68 and 70 allow for receipt of various receptacles illustrated by the circular receptacle 28 and rectilinear receptacle 38. The receptacles are coupled to the rail by use of a support bracket 72. The support bracket includes a hooked end that is operatively associated with the rail slot and can be slid along the length thereof allowing the placement of the receptacles at any position along the length of the rail. In addition, receptacles can be placed on the back side of the rail such as that shown by receptacle 42. The rail 64 can hold numerous receptacles on either side surface, and different receptacle shapes may be present at the same time. The receptacle may be round, oval, square, rectilinear or of any other shaped outline. A slot may also be placed along the bottom of the rail 64 resulting in a symmetrical cross section wherein the rail maybe inverted and/or turned around to provide ease of installation. Receptacles may also be attached to the support bracket 72 with fasteners extending through receptacle surface bores. This allows securement of larger receptacles without enlarge the support brackets.

When desktop supports are used, receptacles may also be attached in a vertical position over the supports. The top end 28 of the spindle is fitted with a bushing 39 through which rod 25 extends to terminate with a removable threaded fitting 44 which protrudes through bushing 39 to secure the assembly together. The threaded fitting may have an external gripper 41 for messages or a CD tower, or the combination of both, which fits into the threaded fitting.

Figure 4:
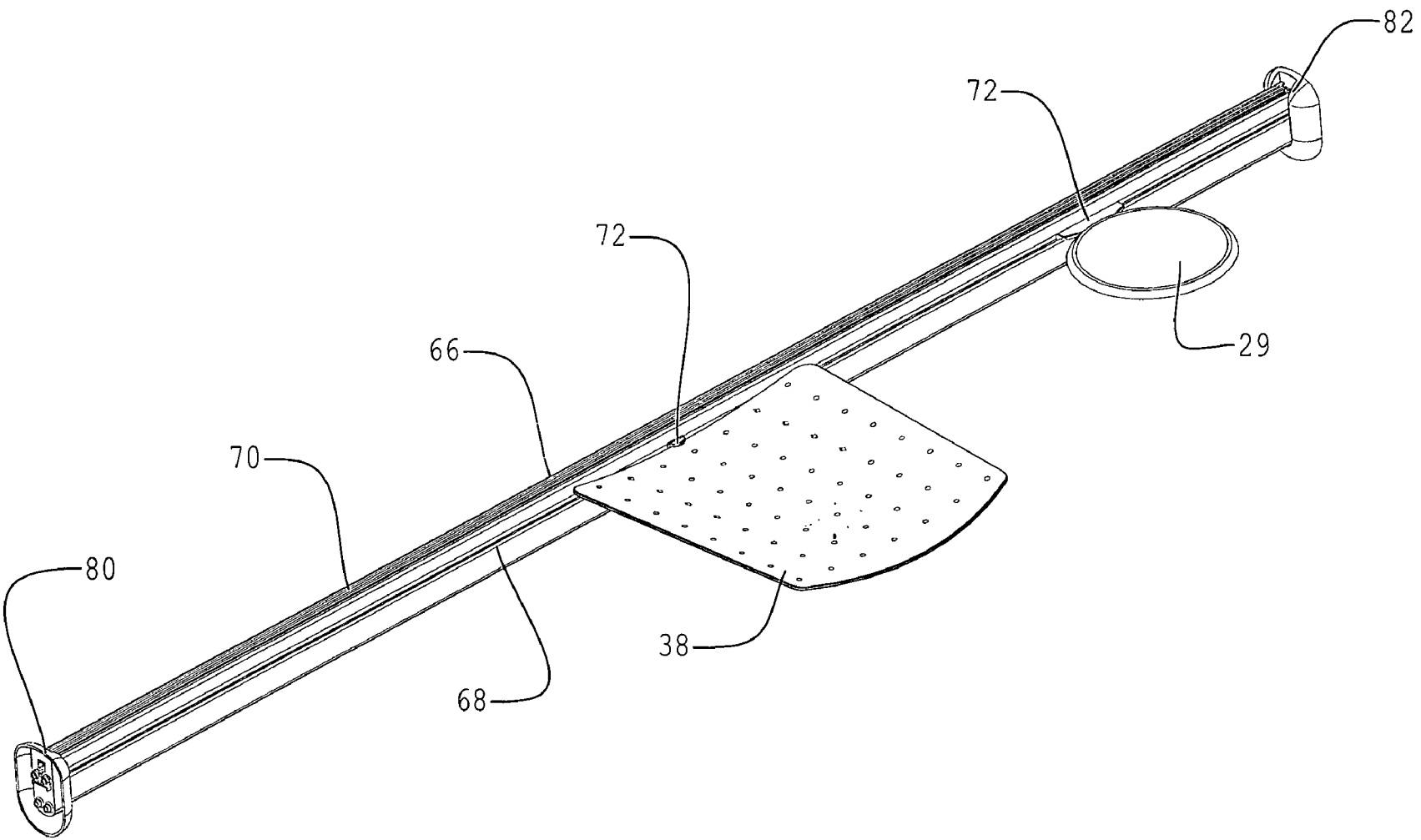
FIG. 4 is a perspective view of the desk organizer in a cabinet/furniture.
Figure 5:
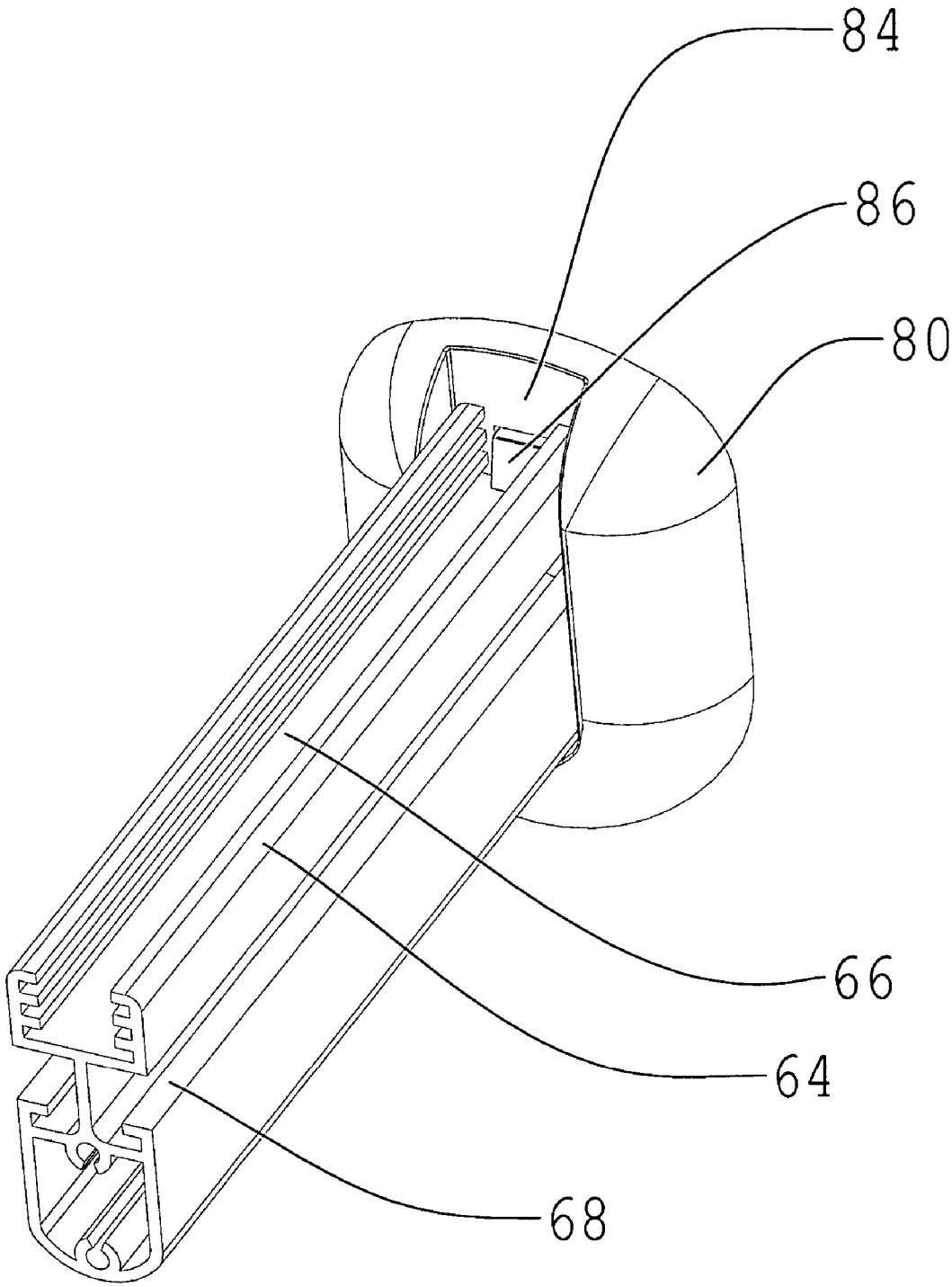
FIG. 5 is an enlarged perspective view of one end of the desk organizer secured to a cabinet/furniture coupling plate.
Figure 6:
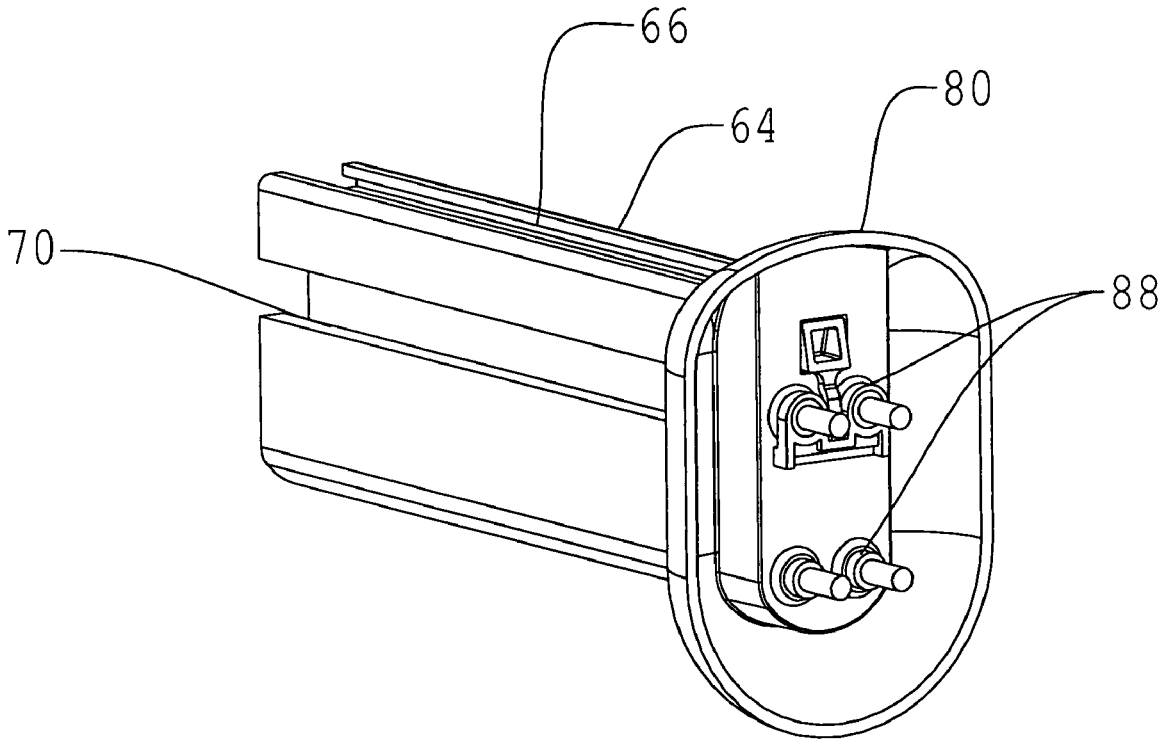
FIG. 6 is a rear view of the cabinet/furniture coupling plate.

Now referring in general to FIGS. 4–6, illustrated is a wall mount embodiment wherein the rail 64 is secured to wall supports 80 and 82. The walls can be cubical wall, cabinet walls, furniture walls and the like. Rail 64 extends between the two wall supports and is secured thereto by insertion of one end of the rail into a receiving socket 84 as shown with wall support 80 shown in FIG. 5. Mounting holes 88 accept screw or nail fasteners to securely attach the wall support to a wall. In addition, the mounting holes can be used to accept fasteners that are used for cubicle wall securement. Tab 86 is a molded part attached onto the wall support, the tab is biased in an extended position to engage the top of the rail. Upon mounting of the wall supports 80 and 82, the rail 64 can be inserted into the receiving sockets wherein the tabs engages the upper slot 70 of the rail. The rail conceals the fasteners but can be removed by depressing of the tab. The rail 64 consists of a slot 66 extending along the length of the top edge, and side slots 68 and 70 located on each side of the rail. The side slots 68 and 70 allow for receipt of various receptacles illustrated by the circular receptacle 29 and rectilinear receptacle 38. The receptacles are also coupled to the rail by use of a support bracket 72. The support bracket has a first end that inserts into the rail slot and can be slid along the length thereof allowing the placement of the receptacle at any position along the length of the rail. In addition, receptacles can be placed on the back side of the rail such as that shown by receptacle 42. Thus, the rail 64 can hold numerous receptacles on either side surface, and different receptacle shapes may be present at the same time. The desk organizer tray may be made of molded polymers or metals or it may be assembled from machined parts.

The foregoing is considered as illustrative only of the principles of the invention. Further, since numerous modifications and changes will occur to those skilled in the art, it is not desired to limit the invention to the exact construction and operation shown and described herein.

What is claimed is:

1. A desk organizer comprising:

a receptacle support rail constructed from a rigid material having a top surface and bottom surface, a first side surface and a second side surface, and a first end and a second end, said rail including at least one mounting slot extending substantially the length of said rail between said first end and said second end;

at least two end supports securable to a fixed structure, each said end support adapted to receive one end of said rail for securely positioning said rail in a horizontal plane, each said end support defined by a post base having an elongated rod within a longitudinal axis with a first end and a second end, said first end of said elongated rod attached to said post base, a tubular spindle rotatably mounted about said longitudinal axis of said rod, said spindle having a bottom end and a top end with a rail receiving socket therebetween; and at least one receptacle slidably securable to said mounting slot.

2. The desk organizer according to claim 1 wherein said tubular spindle has a bottom end, a top end and an intermediate rail receiving receptacle rotatably mounted about said longitudinal axis of said rod.

3. The desk organizer according to claim 1 wherein said fixed structure is a desk.

4. The desk organizer according to claim 1 wherein said fixed structure is a wall.

5. The desk organizer according to claim 1 wherein a plurality of receptacles are securable along the length of said rail.

6. The desk organizer according to claim 1 wherein said receptacle includes at least one rack mounted within a periphery of said receptacle.

7. The desk organizer of claim 1 wherein said tubular spindle includes an integral bracket intermediate said top end and said bottom end, said receptacle affixed to said bracket.

8. The desk organizer of claim 1 wherein said receptacle includes a bracket having a first end slidably securable to said slot, said angle arm having a second end horizontally and vertically displaced from said first end for securement to said receptacle.

9. The desk organizer of claim 8 wherein said bracket includes an angle arm having one end rotatably mounted on said post base, said angle arm having a second end horizontally and vertically displaced from said first end, said first end of said elongated rod rotatably connected to said second end of said angle arm whereby said elongated rod and said angle arm can rotate about said post base.

10. The desk organizer according to claim 1 wherein each said end support is adapted to be attached to a vertical wall surface, each said end support having a means for fastening to said wall and a receiving socket for an end of said rail.

11. The desk organizer according to claim 10 wherein said end support includes a biased tab for securing said rail to said receiving socket.

12. The desk organizer according to claim 1 wherein said rail includes a slot on each side surface allowing the placement of receptacles on each side of said rail.

13. The desk organizer according to claim 1 wherein said rail includes a slot along the top of said rail.

14. A desk organizer comprising:

a receptacle support rail constructed from a rigid material having a top surface and bottom surface, a first side surface and a second side surface, and a first end and a second end, said rail including at least one mounting slot extending substantially the length of said rail between said first end and said second end;

a first and second end support is adapted to be attached to a table top surface, each said end support defined by a post base having an elongated rod within a longitudinal axis with a first end and a second end, said first end of said elongated rod attached to said post base, a tubular spindle rotatably mounted about said longitudinal axis of said rod, said spindle having a bottom end and a top end with a rail receiving socket therebetween;

at least one receptacle slidably securable to said mounting slot.

15. The desk organizer according to claim 14 wherein said support base includes a tubular spindle having a bottom end, a top end and an intermediate rail receiving receptacle rotatably mounted about said longitudinal axis of said rod.

16. The desk organizer according to claim 14 wherein a plurality of receptacles are securable along the length of said rail.

17. The desk organizer according to claim 14 wherein said rail includes a slot on each side surface allowing the placement of receptacles on each side of said rail.

18. The desk organizer according to claim 14 wherein said rail includes a slot along the top of said rail.

* * * * *